US007251837B1

(12) United States Patent
Horton

(10) Patent No.: US 7,251,837 B1
(45) Date of Patent: Aug. 7, 2007

(54) HAND WARMING METHOD AND APPARATUS

(76) Inventor: Charles D. Horton, 8511 Speedway, Shelby Township, MI (US) 48317

( * ) Notice: Subject to any disclaimer, the term of this patent is extended or adjusted under 35 U.S.C. 154(b) by 44 days.

(21) Appl. No.: 11/103,270

(22) Filed: Apr. 11, 2005

(51) Int. Cl.
*A41D 19/00* (2006.01)

(52) U.S. Cl. ..... 2/160; 2/161.6; 2/162

(58) Field of Classification Search ..... 2/158, 2/160, 161.6, 162; 209/211; 219/211; 602/2, 602/3, 5, 21, 62, 64
See application file for complete search history.

(56) References Cited

U.S. PATENT DOCUMENTS

| | | | | | |
|---|---|---|---|---|---|
| 3,463,161 | A | | 8/1969 | Andrassy | |
| 3,869,594 | A | | 3/1975 | Shively | |
| 3,882,873 | A | | 5/1975 | Arango | |
| 4,042,803 | A | | 8/1977 | Bickford | |
| 4,247,097 | A | | 1/1981 | Schwartz | |
| 4,575,075 | A | | 3/1986 | Tarbox et al. | |
| 4,662,433 | A | | 5/1987 | Cahn et al. | |
| 4,684,123 | A | | 8/1987 | Fabry | |
| 4,727,602 | A | * | 3/1988 | Giese et al. | 2/163 |
| 4,742,579 | A | * | 5/1988 | Dunford | 2/160 |
| 4,766,612 | A | | 8/1988 | Patton, Sr. | |
| 4,813,079 | A | | 3/1989 | Reitzel | |
| 4,911,433 | A | | 3/1990 | Walker et al. | |
| 4,961,235 | A | | 10/1990 | Williger | |
| 5,035,003 | A | * | 7/1991 | Rinehart | 2/159 |
| 5,125,117 | A | | 6/1992 | Buenos et al. | |
| 5,187,814 | A | * | 2/1993 | Gold | 2/160 |
| 5,300,000 | A | | 4/1994 | Schwartz | |
| 5,496,358 | A | | 3/1996 | Rosenwald | |
| 5,620,621 | A | * | 4/1997 | Sontag | 219/211 |
| D380,285 | S | | 7/1997 | Babcock | |
| 5,722,482 | A | | 3/1998 | Buckley | |
| 6,141,801 | A | * | 11/2000 | Helenick | 2/159 |
| 2003/0093017 | A1 | * | 5/2003 | Loud | 602/2 |
| 2003/0221238 | A1 | * | 12/2003 | Duboff et al. | 2/160 |
| 2004/0244090 | A1 | * | 12/2004 | Langer | 2/160 |

OTHER PUBLICATIONS

U.S. Appl. No. 09/106,689, Horton.

* cited by examiner

*Primary Examiner*—Katherine Moran
*Assistant Examiner*—Sally Colson Cline
(74) *Attorney, Agent, or Firm*—Carrier, Blackman & Associates, P.C.; William D. Blackman; Joseph P. Carrier

(57) ABSTRACT

A method and apparatus for utilizing heat-generating articles to provide active heating of a user's hand, wherein a heated article is placed near the inside of a user's wrist to cause the user's body temperature to be maintained or actively changed. A holder apparatus for use with a conventional heat pack may include a glove body including a wrist sleeve having an externally accessible pocket for receiving the heat pack. The finger end of the glove body may be truncated to allow the holder apparatus to be worn inside of, and in conjunction with a conventional glove or mitten. The holder apparatus may also include a securing band which serves to engird the inside of the wrist to thereby hold the article closely against the wrist and thereby assure heat transfer between the temperature-altering article and the inside of the wrist.

18 Claims, 4 Drawing Sheets

HAND WARMING METHOD AND APPARATUS

BACKGROUND OF THE INVENTION

1. Field of the Invention

The present invention relates to a method of controlling body temperature during exposure to cold environmental conditions, and to an apparatus useful in practicing the described method. More particularly, the present invention relates to a method of controlling body temperature by holding a heat pack in close proximity to the inside of a user's wrist, and an apparatus usable for holding the heat pack close to the inside of the user's wrist.

2. Description of the Prior Art

People are frequently exposed to environmental conditions which result in discomfort, particularly environmental conditions due to excessive heat or cold. The discomfort caused by hot or cold conditions may be exacerbated by a medical condition, or by other factors, such as lack of movement in cold weather and too much movement in hot weather.

Construction workers and other service workers may be required to spend time outdoors as part of the job, sometimes during the winter months in cold-weather climates. Accordingly, such workers require clothing and equipment which will allow them full mobility, yet which will keep them healthy and relatively comfortable while working under such conditions.

While wearing appropriate clothing is a key to comfort when going out into excessively cold weather, this is a passive solution which merely takes advantage of the fact that to keep warm on cold days, the body generates heat. It would be advantageous if a person could use an active solution which serves to actually heat a portion of the body, as needed.

Hand warmers have long been known to warm the hands of hunters and ice fishermen. These devices typically have a flammable fluid reservoir and a perforated upper body inside of which an exothermal oxidation process occurs which releases heat into the hands of the holder. It has also long been known for persons who will be out in severely cold weather to wear electrically heated socks which are energized by a battery pack carried by the wearer. Recently, chemical technology has provided the consumer with packets that heat or cool when exposed to air and shaken or otherwise kneaded.

For example, a product which produces heat is entitled "Hand Warmer" and is made in Taiwan for Kmart Corp, Troy, Mich. The directions indicate that the packet (having a paper-like outer skin and loose powder inside) is to be removed from its sealed outer pack (having a plastic skin), then shaken or squeezed gently for a few minutes in open air. Thereafter the directions state: "Place packet in your pocket or glove, and it will release heat." The package indicates the product is odorless, harmless, non-toxic and the warmth lasts for hours. The package further indicates that the contents are: iron powder, water, active carbon, salt, polymer and sand, having an approximate net weight of 30 grams. The packet has dimensions of approximately 4 inches by 2.25 inches. It is believed that this product requires oxygen flow around the product, to facilitate an oxidizing reaction which generates heat internally therein.

What remains needed in the art is an optimum methodology for holding a heat pack close to the skin of a user, to provide active heating of the user's body. Ideally, this type of method would promote air flow past a heat pack stored within an article of clothing, to facilitate the oxidation reaction within the heat pack.

SUMMARY OF THE INVENTION

The present invention provides an improved method and apparatus for use in conjunction with a known heat pack, so as to provide active heating of a portion of a user's body, and in particular the hand.

According to one example of a method of the present invention, a heat pack is placed proximate the inner wrist of a user, to thereby cause the temperature of the body of the user to be actively changed as blood flows therepast. The method may include a step of actively moving air past the heat pack, to promote oxidation thereof.

The method of the present invention relies upon the fact that during normal activity, a considerable amount of blood flows inside of the wrist, in an area close to the surface, and that this blood circulates, firstly, into the hand. Consequently, if a heated article is placed close to the inside of the wrist of a person, the blood flowing therepast will be warmed, and this will help to make the person feel warmer. Indeed, it has been found that a heated article, placed against the inside of the wrist, heats the blood flowing into the hand sufficiently that gloves may become optional, even in cold weather.

An apparatus according to another illustrative embodiment of the present invention is in the form of a wearable holder for a temperature-altering article such as a heat pack. One suitable holder according to the invention is a glove body including a wrist sleeve having an externally accessible pocket, for receiving a heat pack therein. While the glove body may have a mitt end or fingers in any well known conventional structure, alternatively, the finger end of the glove body may be truncated, to allow the apparatus to be used in conjunction with a conventional glove or mitten.

The holder may include a securing band which serves to engird the inside of the wrist to thereby hold the heat pack close to the wrist, and thereby promote efficient heat transfer between the heat pack and the inside of the wrist. The holder may further include one or more air passages formed therein, having open end ports, to allow air to flow past a heat pack stored in a pocket of the holder. Where these air passages are used, they may be reinforced to promote good air flow therethrough, and one or more spacer members may be provided inside of the air passages, to ensure that the air passages remain open.

Accordingly, it is an object of the present invention to provide a method to actively warm or cool the body by a localized application of a heated temperature-altering article proximate the inside of the wrist of a user.

It is a further object of the present invention to provide a holder for holding a temperature-altering article, such as a heat pack, near the inside of the wrist of a user, to actively warm the body by a localized application of heat.

These, and additional objects, advantages, features and benefits of the present invention will become apparent from the following specification.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
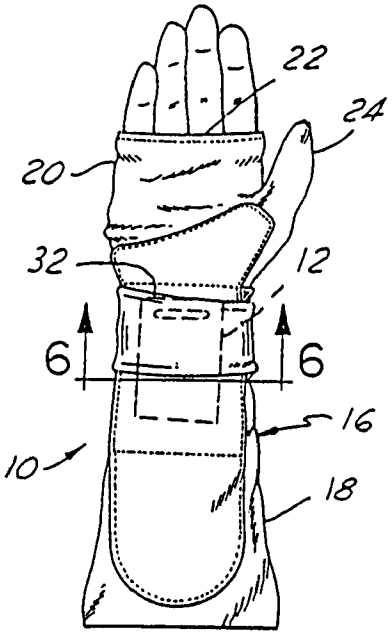
FIG. 1 is a top plan view of a temperature-altering article holder according to the present invention, shown in operation on the wrist of a user.
Figure 2:
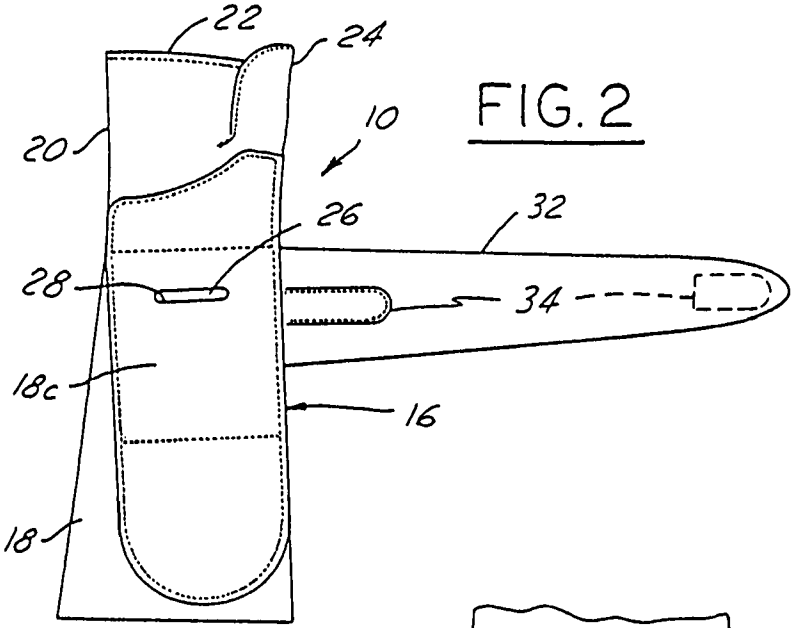
FIG. 2 is a top plan view of the temperature-altering article holder according to the present invention.
Figure 6:
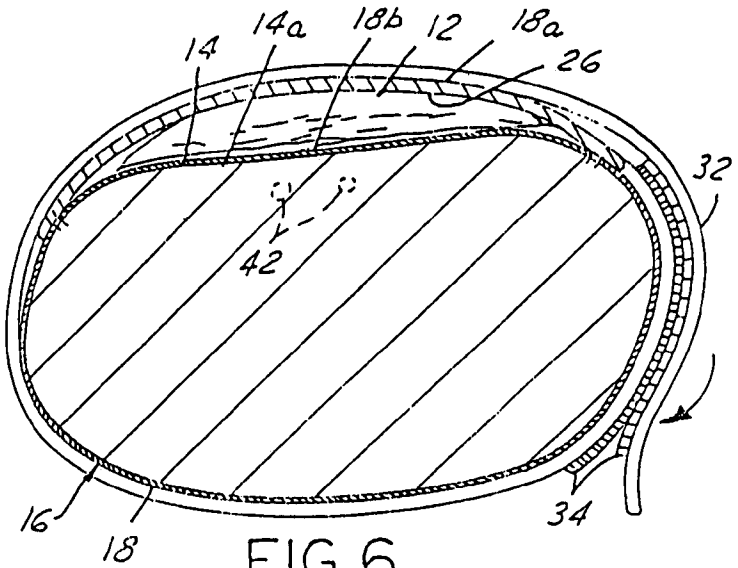
FIG. 6 is a partly sectional end view of the article holder of FIG. 1, seen along line 6-6 thereof.

Referring now to FIG. 1, a holder 10 is shown, for use in holding a temperature-altering article 12 near the inside 14*a* of the wrist 14 of a user (see FIG. 6). It will be noted that in the depicted embodiment, the holder 10 is generally in the form of a glove body 16 having a wrist sleeve 18, for placement surrounding the wrist 14 of a user. In the embodiment of FIG. 1, the glove body 16 includes a palm member 20 which is truncated 22 at the fingers, but which includes a thumb receptacle 24.

The holder 10 is particularly adapted for use with a heat pack as the temperature-altering article 12, in which case, the heat pack 12 is chemically based and in the form of a packet.

One example of a suitable material for use in construction of the glove body 16 is a stretchable elastic or spandex-type of material, however other materials may be used. In one feasible construction of the glove body 16, the wrist sleeve 18 is integral with the palm member 20.

The wrist sleeve 18 includes a pocket 26 which may be accessed through a slit 28 at the outer face 18*a* of the pocket 26. The slit 28 and pocket 26 are dimensioned so that a temperature-altering article 12, such as for example the "Hand Warmer" packet discussed hereinabove, is insertable through the slit, and is capable of being held securely resident inside the pocket. The pocket 26 is preferably thin-walled at the inner face 18*b* thereof (FIG. 6) to thereby facilitate heat transfer between the inside 14*a* of the wrist 14 and the temperature-altering article 12.

In order that the temperature-altering article 12 be kept from heat exchanging with the general environment, an insulating layer 30 may be located at the outer face 18*a* of the pocket 26, also located at the wrist sleeve 18 adjoining the pocket distally with respect to the palm member 20, and also located at the palm member adjoining the pocket and extending to the base 24*a* of the thumb receptacle 24. Where used, the insulating layer 30 enhances body temperature change in response to the temperature-altering article 12 in the pocket 26.

One example of an acceptable structure of the holder 10 is the for glove body to be composed of the aforementioned elastic or spandex-type material, and for a felt-like material to be sewed onto the glove body. The felt-like material may be slitted to provide the slit 28, and may serve simultaneously as the outer face 18*a* of the pocket 26, and as the insulating layer 30.

In order to keep the holder 10 snugly in place on a user's arm, and to ensure and enhance heat exchange between the blood flowing at the inside 14*a* of the wrist 14 and the temperature-altering article 12, the holder may also include a securing band 32 attached to the wrist sleeve 18. The securing band 32 serves to press the temperature-altering article 12 firmly against the inside of the wrist 14. The securing band 32 is connected at a proximate end 32*a* thereof to the wrist sleeve 18, and is sufficiently elongated so as to be able to be wrapped around and engird the wrist 14. The securing band 32 is held tightly about the wrist 14 by a fastener 34, which may be a flexible hook and loop fastener 34*a*, such as for example VELCRO (a trademarked product of Velcro, USA).

Figure 1A:
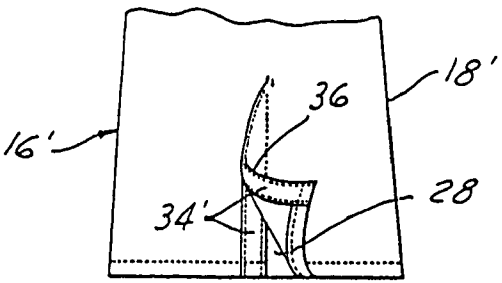
FIG. 1A shows a first variation of the article holder of FIG. 1, wherein a slit thereof is closeable by a flexible hook and loop fastener.

FIG. 1A shows a first variation of the holder 10, wherein the glove body 16' is modified so that the slit 28' is provided with an overlap 36 which is secured closedly by a fastener 34', preferably VELCRO. When the first variation is utilized, the fastener 34' may render the securing band 32 unnecessary.

Figure 7:
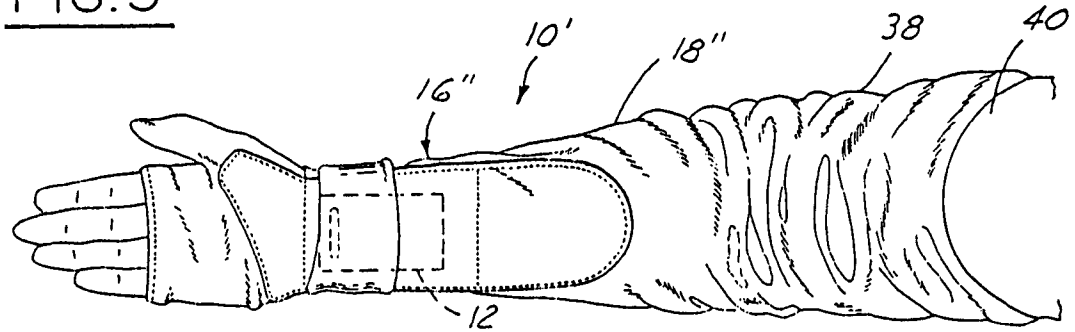
FIG. 7 shows a second variation of the article holder of FIG. 1, wherein an arm extension of the wrist sleeve is provided.

FIG. 7 depicts a second variation of the holder 10, wherein the wrist sleeve 18 now includes a sleeve extension 38 which serves to assist the arm 40 of a user to be temperature altered in response to heat exchange at the inside 14*a* of the wrist 14 with the temperature-altering article 12.

The method according to the present invention is as follows.

Figure 3:
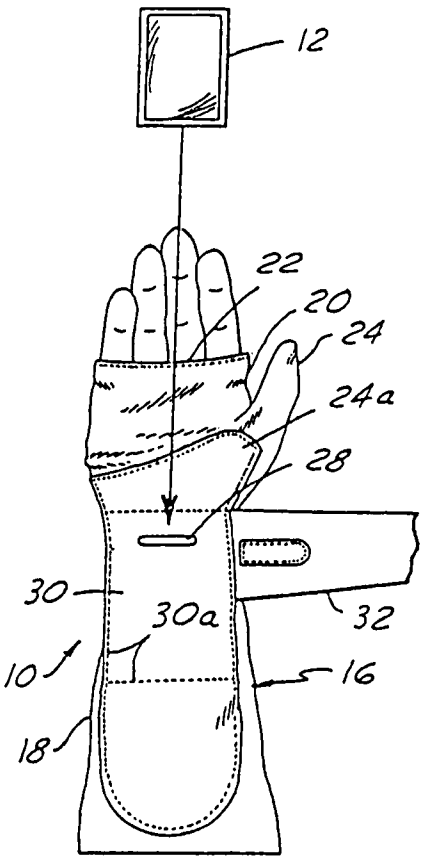
FIG. 3 is a top plan view of the article holder of FIG. 1, showing a temperature-altering article about to be inserted into a slit of the article holder.
Figure 5:
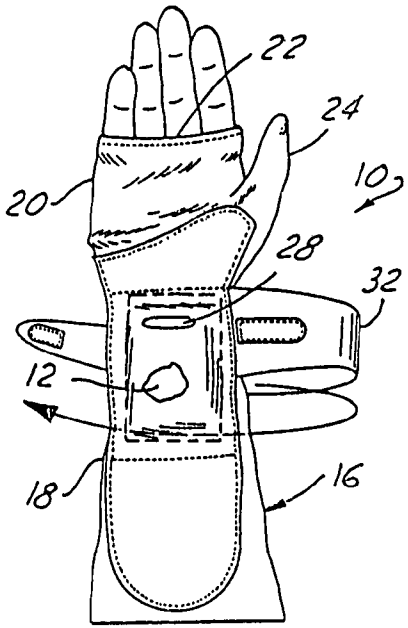
FIG. 5 is a top plan view of the article holder of FIG. 1, showing a temperature-altering article inserted into the pocket of the article holder and the securing band being wrapped about the user's wrist.
Figure 4:
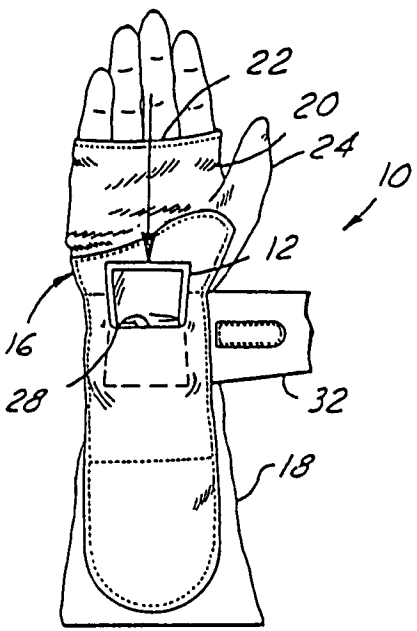
FIG. 4 is a top plan view of the article holder of FIG. 1, showing a temperature-altering article being inserted into the slit of the article holder.

A user grasps the temperature-altering article 12 and performs whatever steps are necessary to activate its heating property so that it is hotter than the ambient temperature of the local environment. The user inserts a hand into the glove body, and then inserts the temperature-altering article through the slit 28 and into the pocket 26 (see FIGS. 3 and 4). The securing band 32 is then tightly wrapped around the wrist, to press the temperature-altering article against the inside 14*a* of the wrist 14 of the hand of the user (see FIGS. 5 and 6). Now, heat will exchange between the blood flowing in blood vessels 42 near the inside of the wrist, thereby actively altering the temperature of the hand, and, in addition, the arm of the hand and the body.

Modified Air-Flow Embodiment

Figure 8:
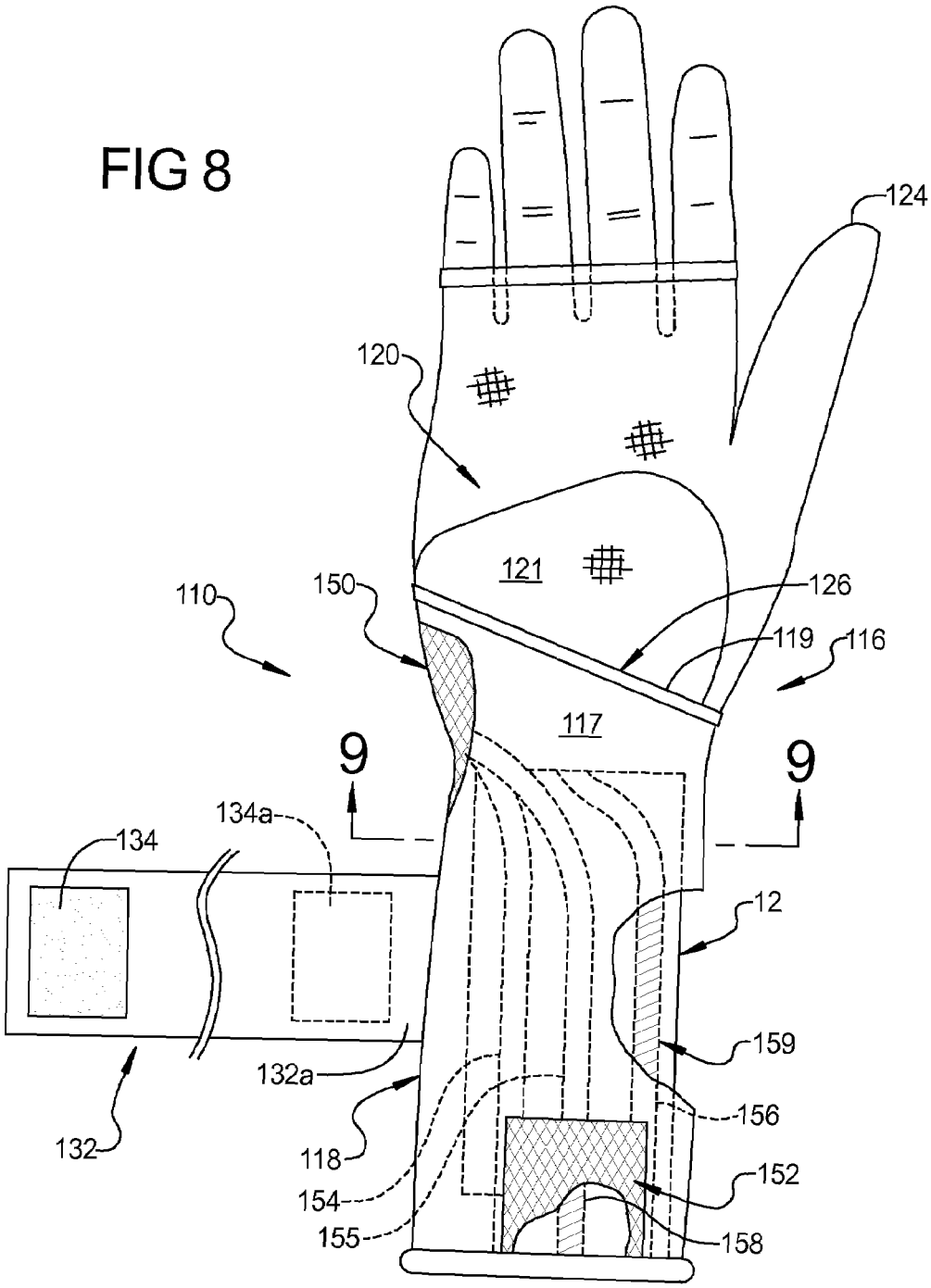
FIG. 8 is a top plan view of an article holder according to another embodiment of the invention, in which reinforced air flow channels are provided within the holder, and open ports are provided at the ends of the reinforced air flow channels.
Figure 9:
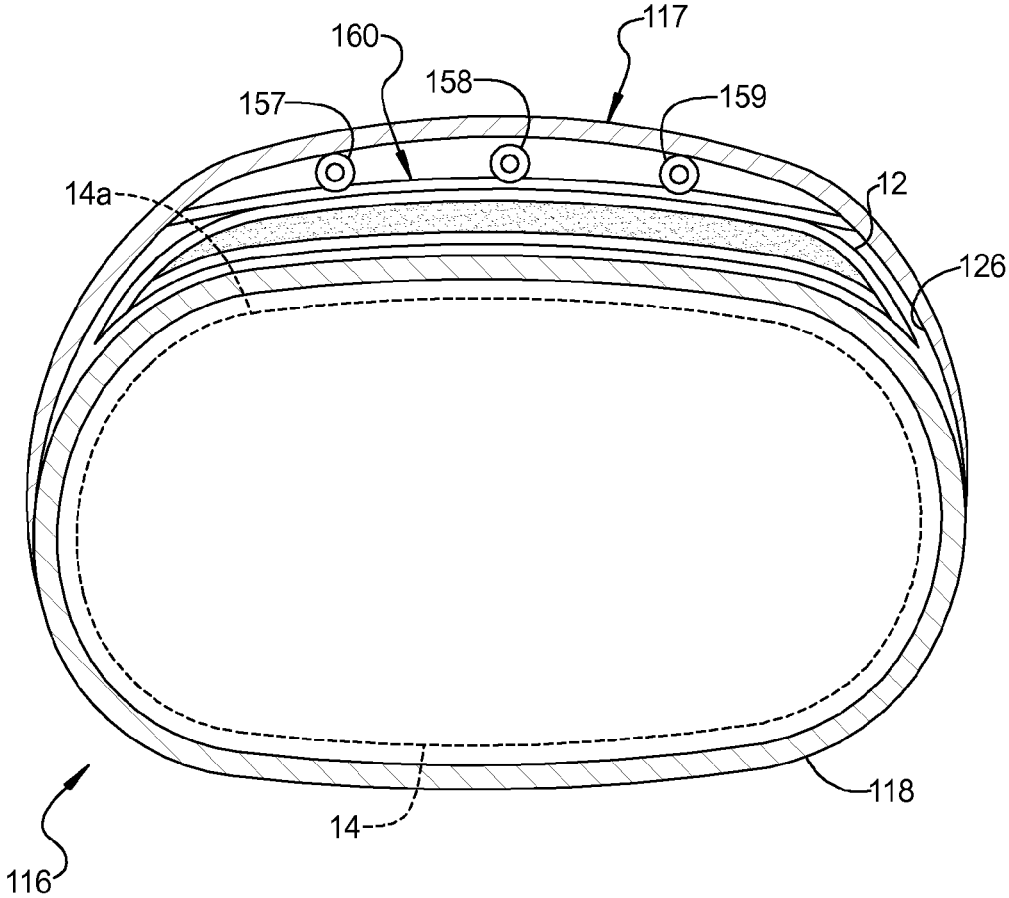
FIG. 9 is a sectional view of the article holder of FIG. 8, taken along the line 9-9 thereof.

Referring now to FIGS. 8-9, another embodiment of a holder 110 is shown, for use in holding a temperature-altering article 12 near the inside 14*a* of the wrist 14 of a user. It will be noted that in the depicted embodiment, the holder 110 is generally in the form of a glove body 116 having a wrist sleeve 118, for placement surrounding the wrist 14 of a user. In the embodiment of FIGS. 7-8, the glove body 116 includes a palm member 120 which is truncated at the fingers, but which includes a thumb receptacle 124. The palm member 120 may include a reinforced and padded section 121, as shown, to provide comfort to a user.

The holder 110 is particularly adapted for use with a heat pack as the temperature-altering article 12, in which case, the heat pack 12 is chemically based and in the form of a packet.

One example of a suitable material for use in construction of the glove body 116 is a stretchable elastic or spandex-type of material, however other materials may be used. In one feasible construction of the glove body 116, the wrist sleeve 118 is integrally attached to the palm member 120, and the glove body 116 also includes an outer wrist blanket 117, which is a separate outer layer sewn on to one side of the wrist sleeve 118.

A pocket 126 is therefore defined, in this embodiment, between the wrist blanket 117 and the wrist sleeve 118. The pocket 126 may be accessed at the outer edge 119 of the wrist blanket 117. The pocket 126 is dimensioned so that a temperature-altering article 12, such as for example the "Hand Warmer" packet discussed hereinabove, is insertable thereinto, and is capable of being held securely resident inside the pocket.

Air Flow Ports

As noted above, the commercially available heat packs require periodic air flow therepast, to support oxidation of chemicals therein. In this embodiment, in order to ensure that air flow is facilitated through the pocket 126, air flow ports 150, 152 are provided in opposite areas of the wrist blanket 117. The air flow ports 150, 152 may be covered with plastic screening, or with an open-weave fabric which has relatively large openings formed therein, such as, for example, a fabric in which the openings in the fabric are equal to or larger than the width of the fabric strands.

Reinforced Air Flow Passages

To further ensure that air flow is facilitated through the pocket 126, and to keep the pocket from collapsing, a plurality of reinforced air flow passages, such as those shown at 154, 155, and 156 in the drawings may be provided inside of the pocket, extending between the air flow ports 150, 152 in the opposite areas of the wrist blanket 117.

One or more perforated tubes or springs such as those shown at 157, 158, 159 may be provided to define relatively rigid side walls of the reinforced air passages 154, 155, 156. These perforated tubes or springs 157, 158, 159, where used, function as reinforcing spacer members provided for spacing the wrist blanket 117 outwardly away from the wrist sleeve 118. A thin intermediate layer of screening or highly porous fabric 160 may be provided below the reinforced air flow passages to hold the perforated tubes or springs 157, 158, 159 in place as reinforcement members, and this fabric 160 may be a continuation of the material covering the air flow ports 150, 152. If desired, the reinforced air flow passages may be sewn in place within the pocket 126, or otherwise may be attached to the lower surface of the wrist blanket 117.

One example of an equivalent structure which could be used in place of the perforated tubes or springs 157, 158, 159 could be that a substantially rigid plastic reinforcing member could be used, either in place of the wrist blanket 117 or as a reinforcement to keep the wrist blanket 117 in a position spaced away from the wrist sleeve 118.

In order that the temperature-altering article 12 be kept from heat exchanging with the general environment, an added insulating layer may be located beneath the wrist blanket 117, similar to the layer 30 shown in FIG. 6. Where used, the insulating layer 30 enhances body temperature change in response to the temperature-altering article 12 in the pocket 126.

In order to keep the holder 110 snugly in place on a user's arm, and to ensure and enhance heat exchange between the blood flowing at the inside 14*a* of the wrist 14 and the temperature-altering article 12, the holder may also include a securing band 132 attached to the wrist sleeve 118. The securing band 132 serves to press the temperature-altering article 12 firmly against the inside of the wrist 14. The securing band 132 is connected at a proximate end 132*a* thereof to the wrist sleeve 18, and is sufficiently elongated so as to wrappably engird the wrist 14. The securing band 132 is held tightly about the wrist 14 by a fastener 134, preferably a flexible hook and loop fastener 134*a*, such as for example VELCRO (a trademarked product of Velcro, USA).

The present invention also relates to a method of using the described holder apparatus 110 to actively warming a user's body. The method includes a first step of activating a heat pack 12 to cause the heat pack to become warmer than a local ambient environment. The method also includes a step of placing a holder apparatus around the wrist of a user. The holder apparatus used in the method hereof may be the holder 110 of the modified air-flow embodiment as described herein.

Once the heat pack 12 is activated, the user places the activated heat pack in the pocket 126 of the apparatus 110 near an inside portion of a wrist 14 of a user, to thereby cause thermal exchange between the heat pack and blood flowing adjacent the inside of the user's wrist.

As noted above, the holder 110 may include insulation, to thereby limit thermal interaction of the temperature-altering article with the local environment.

The method may, optionally, include a further step of covering a selected portion of the user adjacent the wrist to facilitate thermal heat exchange.

Another optional step which may be used in the method hereof involves flexing part of the user's arm or hand, to promote air flow through the air flow passages 154, 155, 156. This flexing may involve pivotally moving the user's arm about the elbow, which is believed to create a bellows-like action in forcing air over the heat pack 12, to promote the heat-generating oxidation reaction therein.

To those skilled in the art to which this invention appertains, the above described described embodiment may be subject to change or modification. Such change or modification can be carried out without departing from the scope of the invention, which is intended to be limited only by the scope of the appended claims.

What is claimed is:

1. A holder apparatus for being worn by a user and for storing and holding a non-electrical heat pack therein to provide warmth to the user, said holder comprising:

a glove body comprising a palm member and a wrist sleeve connected to said palm member;

wherein said palm member is provided for covering a palm portion of the user's hand;

wherein said wrist sleeve comprises a flexible tubular sheath for placement surrounding a wrist of the user, said wrist sleeve having a palm side for contacting an inside portion of the user's wrist adjacent the palm member, and a back side for contacting an outside portion of the user's wrist;

a wrist blanket operatively attached to the palm side of said wrist sleeve and cooperating therewith to form a pocket for receiving and holding said heat pack, said wrist blanket having at least two spaced apart air flow ports formed as openings therein and an air flow channel defined between said air flow ports, said air flow channel in communication with said pocket, whereby air is able to enter the air flow channel and communicate with said pocket through at least one of the air flow ports;

wherein said glove body is structured so that when said glove body is worn by a user and a heat pack is placed into said pocket, the heat pack warms the wrist of the user, and air is able to access the heat pack via the at least one air flow channel.

2. The holder apparatus of claim 1, further comprising at least one spacer member disposed between the wrist blanket and the wrist sleeve for spacing the wrist blanket away from the wrist sleeve, wherein at least one air flow channel is defined between the wrist blanket and the wrist sleeve by the spacer member.

3. The holder apparatus of claim 2, wherein said at least one spacer member comprises a spring.

4. The holder apparatus of claim 1, wherein said palm member further comprises a thumb receptacle.

5. The holder apparatus of claim 1, further comprising a securing band for wrapping around said wrist sleeve adjacent said pocket.

6. A holder for being worn by a user and for storing and holding a non-electrical heat pack therein to provide warmth to the user, said holder comprising:

a glove body comprising a palm member and a wrist sleeve connected to said palm member;

a wrist blanket operatively attached to said wrist sleeve and cooperating therewith to form a pocket for receiving and holding said heat pack, said wrist blanket having at least two spaced apart air flow ports formed therein;

a porous intermediate layer provided between said wrist blanket and said wrist sleeve, and at least one spacer member disposed between the wrist blanket and the wrist sleeve on an opposite side of the intermediate layer from the pocket, for spacing the wrist blanket away from the wrist sleeve, wherein at least one air flow channel is defined between the wrist blanket and the wrist sleeve by the spacer member, said air flow channel in communication with said pocket, whereby air is able to enter the air flow channel through at least one of the air flow ports;

wherein said glove body is structured so that when said glove body is worn by a user and a heat pack is placed into said pocket, the heat pack warms the wrist of the user, and air is able to access the heat pack via the at least one air flow channel.

7. The holder of claim 6, further comprising an insulating material located inside of said wrist blanket.

8. The holder of claim 6, wherein said at least one spacer member comprises a spring.

9. The holder of claim 6, wherein said palm member further comprises a thumb receptacle.

10. A method of actively warming a body, said method comprising the steps of:

activating a chemically-based heat pack to cause the heat pack to become warmer than a local ambient environment;

placing a holder apparatus around the wrist of a user, said holder apparatus comprising the holder apparatus of claim 1;

and placing the heat pack in the pocket of the apparatus near an inside portion of a wrist of a user to thereby cause thermal exchange between the heat pack and blood flowing adjacent the inside of the user's wrist.

11. The method of claim 10, wherein the holder apparatus includes insulation, to thereby limit thermal interaction of the holder apparatus with a local environment.

12. The method of claim 10, further comprising a step of covering a selected portion of the user adjacent the wrist to thereby facilitate said thermal heat exchange.

13. The method of claim 10, further comprising a step of flexing part of the user's arm or hand, to promote air flow through said air flow passages.

14. The method of claim 13, wherein the flexing step includes pivotally moving the user's arm about the elbow, to promote air flow through said air flow passages.

15. A holder apparatus for being worn by a user and for temporarily holding a non-electrical heat pack therein to provide warmth to the user, said holder apparatus comprising:

a glove body, comprising a palm member and a wrist sleeve integrally connected to said palm member, wherein said palm member is provided for covering a palm portion of the user's hand, said palm member comprising a thumb receptacle and having an open end to allow fingers of the user to extend outwardly therefrom;

wherein said wrist sleeve comprises a flexible tubular sheath for placement surrounding a wrist of the user, said wrist sleeve having a palm side for contacting an inside portion of the user's wrist adjacent the palm member, and a back side for contacting an outside portion of the user's wrist;

said glove body further comprising a wrist blanket comprising a separate outer layer operatively attached to the palm side of the wrist sleeve, and a porous intermediate layer disposed between said wrist blanket and said wrist sleeve, said wrist blanket cooperating with said wrist sleeve to form a pocket therebetween on one side of said intermediate layer for receiving and holding said non-electrical heat pack, said wrist blanket having at least two spaced apart air flow ports formed as openings therein;

and at least one tubular spacer member, disposed between the wrist blanket and the wrist sleeve on the other side of said intermediate layer from said pocket, for spacing the wrist blanket away from the wrist sleeve, whereby at least one reinforced air flow channel is defined extending between and interconnecting the air flow ports of said wrist blanket;

wherein said glove body is structured so that when said glove body is worn by a user and a heat pack is placed into said pocket, the heat pack warms the wrist of the user, and air is able to access the heat pack via the at least one air flow channel.

16. The holder apparatus of claim 15, wherein said reinforced tubular spacer member comprises a spring.

17. The holder apparatus of claim 15, further comprising a securing band for wrapping around said wrist sleeve adjacent said pocket.

18. The holder apparatus of claim 15, wherein the air flow ports are covered with plastic screening or with an open-weave fabric.

* * * * *